US011066822B2

(12) United States Patent
Zheng

(10) Patent No.: US 11,066,822 B2
(45) Date of Patent: Jul. 20, 2021

(54) TOILET ELECTROMAGNETIC DISTRIBUTOR

(71) Applicant: Shanghai Kohler Electronics Ltd., Shanghai (CN)

(72) Inventor: Jianrui Zheng, Shanghai (CN)

(73) Assignee: SHANGHAI KOHLER ELECTRONICS LTD., Shanghai (CN)

( * ) Notice: Subject to any disclaimer, the term of this patent is extended or adjusted under 35 U.S.C. 154(b) by 42 days.

(21) Appl. No.: 16/549,331

(22) Filed: Aug. 23, 2019

(65) Prior Publication Data

US 2020/0071921 A1 Mar. 5, 2020

(30) Foreign Application Priority Data

Aug. 28, 2018 (CN) ..... 201810990362.8

(51) Int. Cl.
*E03D 9/08* (2006.01)
*E03D 11/13* (2006.01)

(52) U.S. Cl.
CPC ..... *E03D 9/08* (2013.01); *E03D 11/13* (2013.01)

(58) Field of Classification Search
CPC ..... E03D 9/08; E03D 11/13
USPC ..... 4/443
See application file for complete search history.

(56) References Cited

FOREIGN PATENT DOCUMENTS

CN 101249479 A * 8/2008

OTHER PUBLICATIONS

English machine translation of CN 101 249 479 A printed Dec. 8, 2020 (Year: 2020).*

* cited by examiner

*Primary Examiner* — Christine J Skubinna
(74) *Attorney, Agent, or Firm* — Foley & Lardner LLP

(57) ABSTRACT

An electromagnetic distributor and a toilet including such a distributor, which includes a housing and a water channel disposed within the housing. The water channel comprising an inlet, which is disposed at a first end of the housing, and an outlet, which extends toward a second end of the housing. A water discharge assembly is disposed at the second end of the housing. A water discharge chamber is disposed within the water discharge assembly, with an outlet of the water channel in fluid communication with the water discharge chamber, and at least two water outlets disposed on a face of the water discharge assembly furthest away from the housing. A solenoid valve assembly is disposed inside the housing. The solenoid valve assembly includes at least two electromagnetic switches, each associated with one of the at least two water outlets. Each electromagnetic switch independently controls opening/closing of the associated water outlet.

17 Claims, 9 Drawing Sheets

TOILET ELECTROMAGNETIC DISTRIBUTOR

CROSS-REFERENCE TO RELATED PATENT APPLICATIONS

This application claims priority to and the benefit of Chinese Priority Application No. 201810990362.8, filed Aug. 28, 2018. The entire disclosure of the foregoing application including the specification, drawings, claims and abstract, is incorporated herein by reference.

TECHNICAL FIELD

The present disclosure relates to the field of intelligent bathroom equipment-related technologies. More specifically, this application relates to an electromagnetic distributor for use with toilets and the like.

BACKGROUND

A water path distributor is typically provided in a water system of intelligent bathroom equipment for controlling water paths to achieve a water discharge mode desired by users. A conventional distributor typically controls water paths through engagement of a stator and a rotor. Specifically, a plurality of water inlets are formed circumferentially on the stator and one water outlet is formed on the stator, such that the water outlet and the water inlets are on the same circle. A stepper motor or the like provides a driving force to make the rotor and the stator rotate with respect to each other. When the water outlet on the rotor is aligned with one of the water inlets on the stator, one water path is open, while other water paths are in a closed state, thereby switching different water paths.

However, the above conventional distributor has the following defects. The conventional distributor is suitable for being arranged outside of a nozzle (e.g., a nozzle for cleaning bodies), and when the nozzle is preset with several water paths, it requires the same number of water pipes to be introduced into the nozzle, which leads to a complex structure. For existing distributors, a stepper motor rotates circumferentially to control positions of water outlets to switch among different water paths, which leads to a long response time and cannot meet the requirement for a quick switch. Lastly, the water paths of an existing distributor cannot be turned on or off independently, and only one path can be turned on at any moment, which does not meet diversified water discharge requirements.

SUMMARY

In light of the issues and limitations noted above, it would be advantageous to provide an electromagnetic distributor for toilets, which is intended to overcome the defects, such as a complex structure, long response time, and unchanged water discharge mode.

The present disclosure provides such an electromagnetic distributor. At least one embodiment of the device includes a housing and a water channel disposed within the housing. The water channel includes an inlet, which is disposed at a first end of the housing, and an outlet, which extends toward a second end of the housing. The embodiment further includes a water discharge assembly disposed at the second end of the housing and a water discharge chamber disposed within the water discharge assembly. An outlet of the water channel is in fluid communication with the water discharge chamber, and at least two water outlets are disposed on a face of the water discharge assembly furthest away from the housing. Lastly, the embodiment includes a solenoid valve assembly disposed inside the housing. The solenoid valve assembly includes at least two electromagnetic switches, each associated with the at least two water outlets, and each electromagnetic switch independently controls opening/closing of the associated water outlet.

At least one embodiment of the electromagnetic distributor includes an inlet end cap disposed at the first end of the housing and configured with a water incoming chamber thereon. The water incoming chamber is in communication with the air, and the inlet of the water channel is in communication with the water incoming chamber.

At least one embodiment of the inlet end cap seals the first end of the housing.

At least one embodiment of each of the water outlets includes a plug that is located in the water discharge chamber. Each of the electromagnetic switches controls an open/close state of the corresponding water outlet by independently controlling a state of the corresponding plug.

At least one embodiment of the water discharge assembly includes a spring bracket and a splitter plate. The spring bracket and the splitter plate together define the water discharge chamber.

At least one embodiment includes the spring bracket disposed at one side close to the solenoid valve assembly, the splitter plate disposed at one side away from the solenoid valve assembly, the water outlets configured on the splitter plate, and the plugs mounted on the spring bracket.

At least one embodiment of the plugs include the plus connected to the spring bracket via elastic members, and an elastic force of the elastic members causes the plugs to seal the corresponding water outlets.

At least one embodiment of the spring bracket includes the spring bracket configured with at least two mounting grooves, and the plugs correspondingly, one-to-one, mounted inside the mounting grooves. The first end of the plug is moveably connected to a first inner wall of the mounting groove, a second end of the plug is connected, via the elastic member, to a second inner wall of the mounting groove opposing the first inner wall, and an elastic force of the elastic members causes the second end of the plug to approach the corresponding water outlet.

At least one embodiment of a distance between the first end of the plug and the water outlet includes a greater distance than a distance between the second end of the plug and the water outlet in a non-operating state.

At least one embodiment of each of the electromagnetic switches includes a switch bracket and a coil wound around the switch bracket. A magnetic force is generated when the coil is energized, and the magnetic force acts on the corresponding plug to control an open/close state of the plug.

At least one embodiment of the electromagnetic distributor further includes a control circuit board. The control circuit board controls the energizing state of the coil.

At least one embodiment of each of the coils includes the coils configured with a permanent magnet.

At least one embodiment of each of the coils includes the coils inserted with a static iron core, and magnetic sheets are mounted on the solenoid valve assembly.

At least one embodiment of the present disclosure relates to a toilet that includes a nozzle for cleaning bodies and the electromagnetic distributor according to any one of the preceding paragraphs or disclosed herein. The electromagnetic distributor is disposed inside the nozzle. An outer wall of the housing is attached to an inner wall of the nozzle, the first end of the housing faces an upstream direction of the nozzle, and the second end of the housing faces a downstream direction of the nozzle.

With the electromagnetic distributor according to embodiments of the present disclosure, the solenoid valve assembly can independently control each of the water outlets to be opened or closed, thereby achieving a water discharge mode desired by a user. Such electromagnetic distributor can be disposed inside a nozzle and does not need to be arranged separately outside the nozzle. Moreover, a plurality of water paths can be combined and switched by only introducing one water pipe into the nozzle, thereby simplifying the overall nozzle structure. The implementation of rapid switch and control of on and off of each water path in the nozzle as controlled by the solenoid valve assembly greatly shortens the response time and can meet the requirements of rapid switch and control. In addition, a plurality of electromagnetic switches are integrated, which can divide one path of incoming water into a plurality of paths of water discharge, and the plurality of paths can be controlled independently with no mutual interference, thereby meeting diversified water discharge requirements.

BRIEF DESCRIPTION OF THE DRAWINGS

The disclosure will become more fully understood from the following detailed description, taken in conjunction with the accompanying figures, wherein like reference numerals refer to like elements.

DETAILED DESCRIPTION

The present application will be further described in detail below with reference to the accompanying drawings and specific embodiments.

Figure 1:
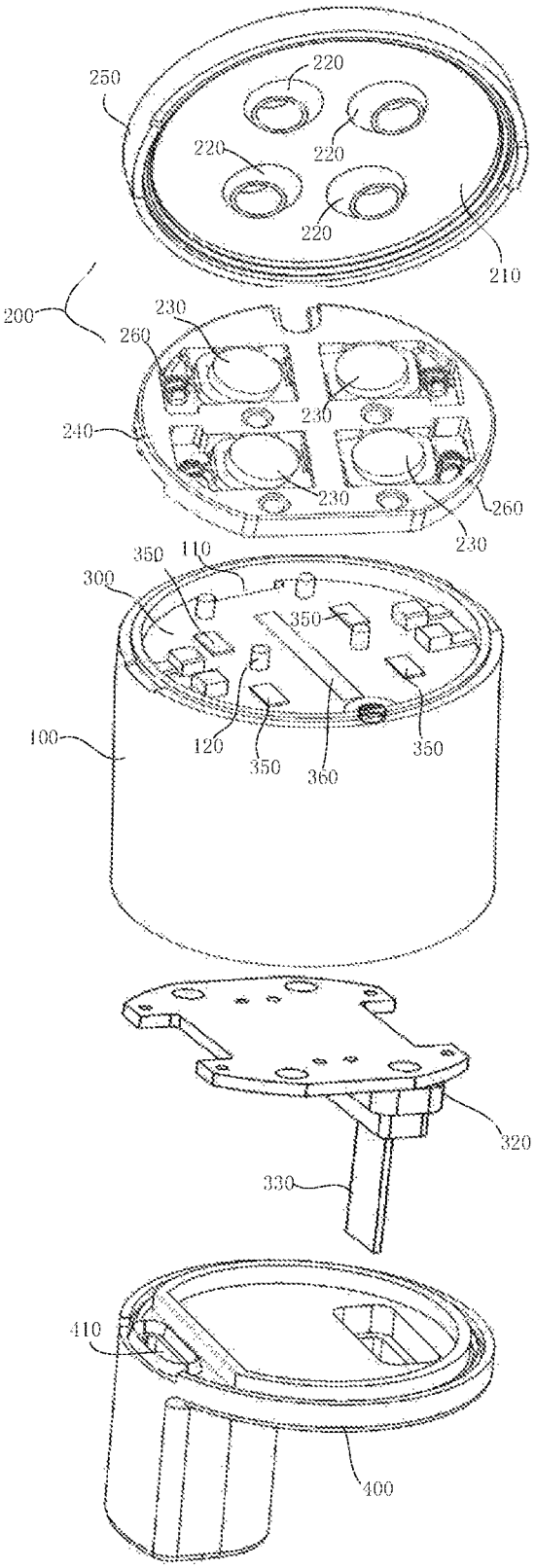
FIG. 1 is a schematic view of an electromagnetic distributor, according to an embodiment of the present application.

FIG. 1 illustrates an exemplary embodiment of an electromagnetic distributor according to the present application. The illustrated electromagnetic distributor includes a housing 100, a water discharge assembly 200, and a solenoid valve assembly 300.

Figure 2:
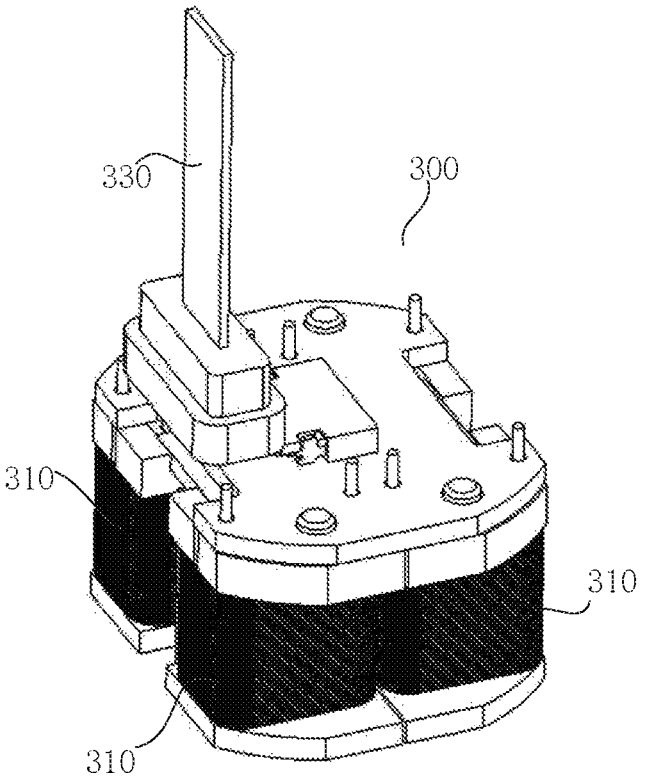
FIG. 2 is a schematic view of a solenoid valve assembly in the electromagnetic distributor, according to an embodiment of the present application.
Figure 3:
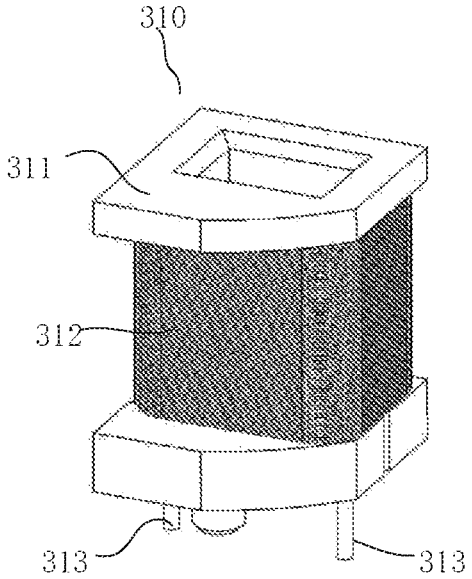
FIG. 3 is a schematic view of a single electromagnetic switch, according to an embodiment of the present application.
Figure 4:
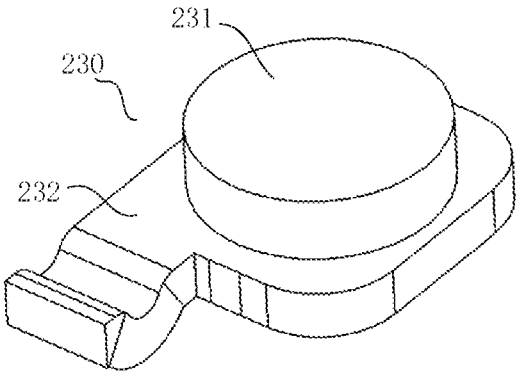
FIG. 4 is a schematic view of a single plug, according to an embodiment of the present application.
Figure 5:
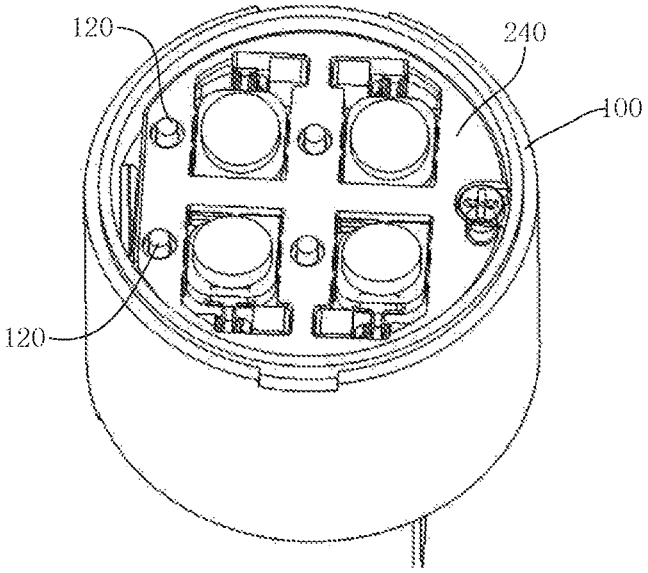
FIG. 5 is a schematic view of an assembly of the housing and the spring bracket, according to an embodiment of the present application.

FIG. 2 illustrates the solenoid valve assembly 300 of the electromagnetic distributor according to the present application. FIG. 3 illustrates a single electromagnetic switch 310 according to the present application. FIG. 4 illustrates a single plug 230 according to the present application. FIG. 5 illustrates an assembly of the housing 100 and the spring bracket 240 according to the present application.

FIGS. 1-5 illustrate the housing 100, which includes a water channel 110 therein. An inlet of the water channel 110 is located at a first end of the housing 100, and an outlet of the water channel 110 extends toward a second end of the housing 100. The illustrated housing 100 has a cylindrical or approximately cylindrical cavity structure with an opening formed on both ends. The water channel 110 may be formed with a channel structure in the housing 100 or may be formed with a water pipe in the housing 100. In FIG. 1, the inlet of the water channel 110 is located on the bottom end surface (the end surface of the first end) of the housing 100, and the outlet of the water channel 110 extends to the top end surface (the end surface of the second end) of the housing 100.

The water discharge assembly 200 is disposed at the second end of the housing 100 and is configured with a water discharge chamber 210 therein. An outlet of the water channel 110 is in communication (e.g., fluid communication, structural, etc.) with the water discharge chamber 210. In a specific embodiment, the water discharge assembly 200 includes a spring bracket 240 and a splitter plate 250. The spring bracket 240 and the splitter plate 250 together define the water discharge chamber 210. At least one water outlet 220 is located on a face of the water discharge assembly 200. As shown in FIG. 1, four water outlets 220 are formed on a face of the water discharge assembly 200 furthest away from the housing 100, and each of the water outlets 220 is provided with a plug 230. The plug 230 is located in the water discharge chamber 210. The water outlets 220 are used to guide one or more paths of water flow to the inlet of a nozzle of a downstream module of the electromagnetic distributor, respectively. In at least one embodiment, the spring bracket 240 is disposed at one side close to the solenoid valve assembly 300, the splitter plate 250 is disposed at one side away from the solenoid valve assembly 300, the water outlets 220 are formed on the splitter plate 250, and the plugs 230 are mounted on the spring bracket 240. The plugs 230 are connected to the spring bracket 240 via elastic members 260. An elastic force of the elastic members 260 causes the plugs 230 to seal the corresponding water outlets 220.

FIG. 4 illustrates the plug 230 including a rubber gasket 231 and a metal sheet 232. The rubber gasket 231 is mounted above the metal sheet 232. The rubber gasket 231 is used to seal the water outlet 220, and the metal sheet 232 is used to fix the rubber gasket 231 in the water discharge chamber 210. In at least one such embodiment, the metal sheet 232 is connected with the spring bracket 240 via the elastic member 260. The elastic member 260 may be a torsion spring.

An exemplary implementation process includes the following steps. The water discharge assembly 200 is not limited to the discrete structure set forth in the above embodiments, but may also be an integrally formed cavity structure. The cavity structure is in communication with the water channel 110, such that water flow in the water channel 110 can flow into the cavity structure. The water discharge assembly 200 may further be used to seal the second end of the housing 100 to prevent water from flowing from other positions than the water outlets 220 to affect the water spray effect.

The solenoid valve assembly 300 is disposed inside the housing 100. The solenoid valve assembly 300 includes at least two electromagnetic switches 310. The electromagnetic switches 310 correspond one-to-one to the plugs 230, and each of the electromagnetic switches 310 independently controls an open/close state of a corresponding plug 230.

FIGS. 1-9 illustrate an embodiment which includes four water outlets 220 to correspond to four plugs 230 and four electromagnetic switches 310. It should be understood that the electromagnetic distributor according to the present application is not limited thereto, and other numbers may be set up as needed.

In a non-operating state, each of the plugs 230 seals the corresponding water outlet 220 when acted on by the elastic member 260. When any one of the electromagnetic switches 310 is turned on, the corresponding plug 230 is configured to open, such that the water discharge chamber 210 is in communication with the air via the opened water outlet 220 and water in the water discharge chamber 210 can be sprayed out via the opened water outlet 220.

With the electromagnetic distributor according to the embodiment of the present application, the solenoid valve assembly 300 can independently control each of the water outlets 220 to open or close, thereby achieving a water discharge mode desired by a user. Such electromagnetic distributor can be disposed inside a nozzle, for instance, inside a nozzle for cleaning bodies, and does not need to be arranged separately outside the nozzle. Moreover, a plurality of water paths can be combined and switched by only introducing one water pipe into the nozzle, thereby simplifying the overall nozzle structure. The implementation of rapid switch and control of on and off of each water path in the nozzle as controlled by the solenoid valve assembly 300 greatly shortens the response time and can meet the requirements of rapid switch and control. In addition, a plurality of electromagnetic switches 310 are integrated, which can divide one path of incoming water into a plurality of paths of water discharge, and the plurality of paths can be controlled independently with no mutual interference, thereby meeting diversified water discharge requirements.

Figure 6:
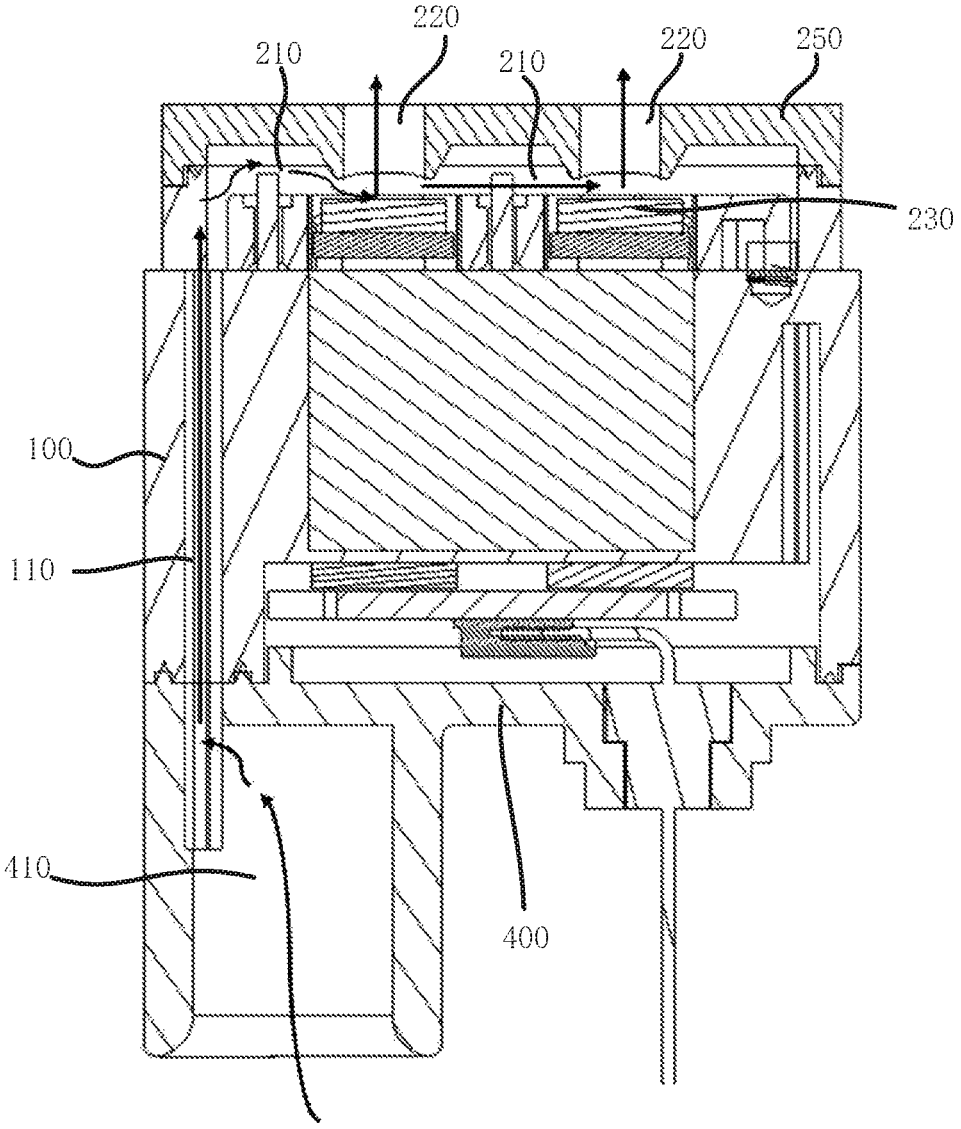
FIG. 6 is a schematic view of a water flow path of the electromagnetic distributor, according to an embodiment of the present application.
Figure 7:
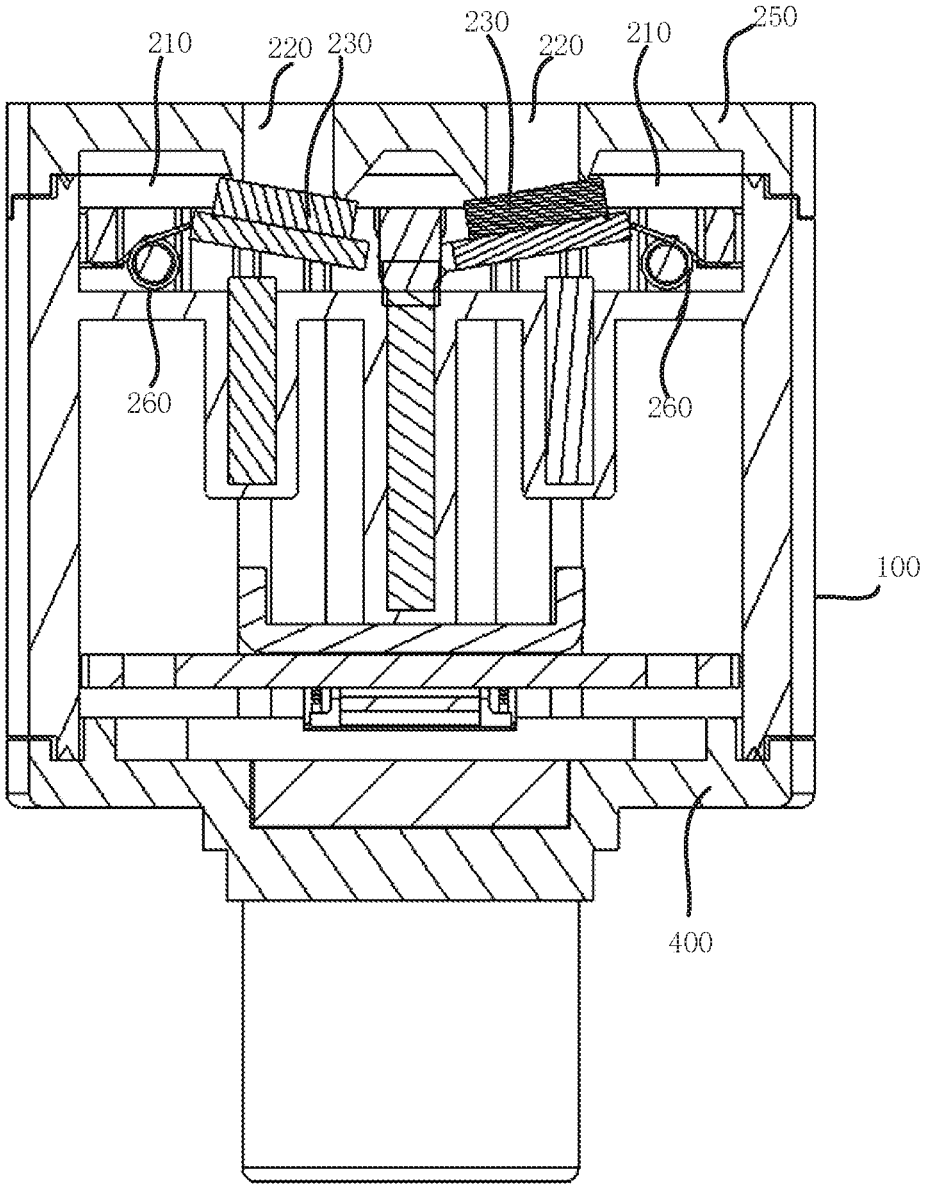
FIG. 7 is a schematic view of the electromagnetic distributor in a non-operating state, according to an embodiment of the present application.
Figure 8:
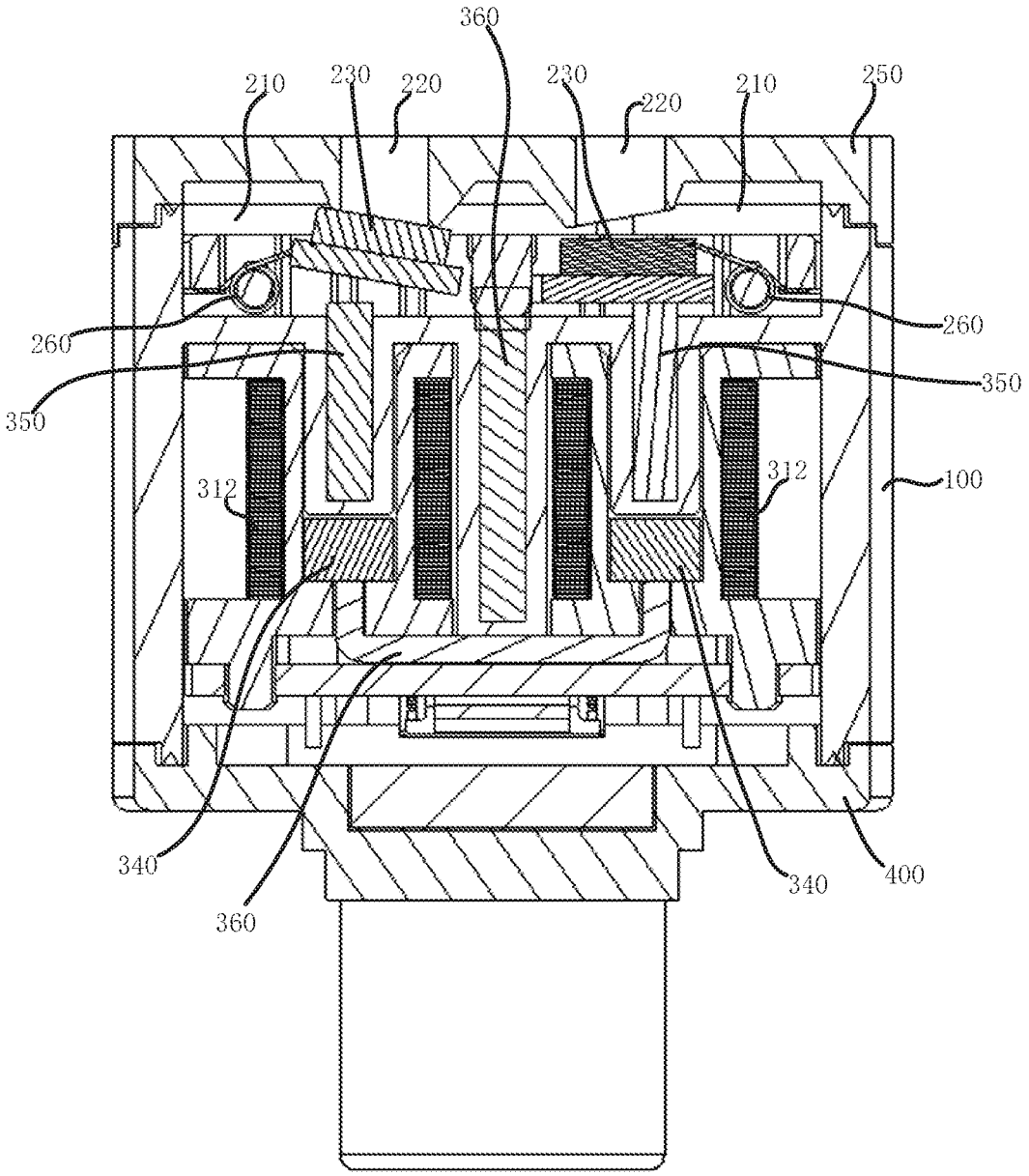
FIG. 8 is a schematic view of a single path of the electromagnetic distributor in an open state, according to an embodiment of the present application.
Figure 9:
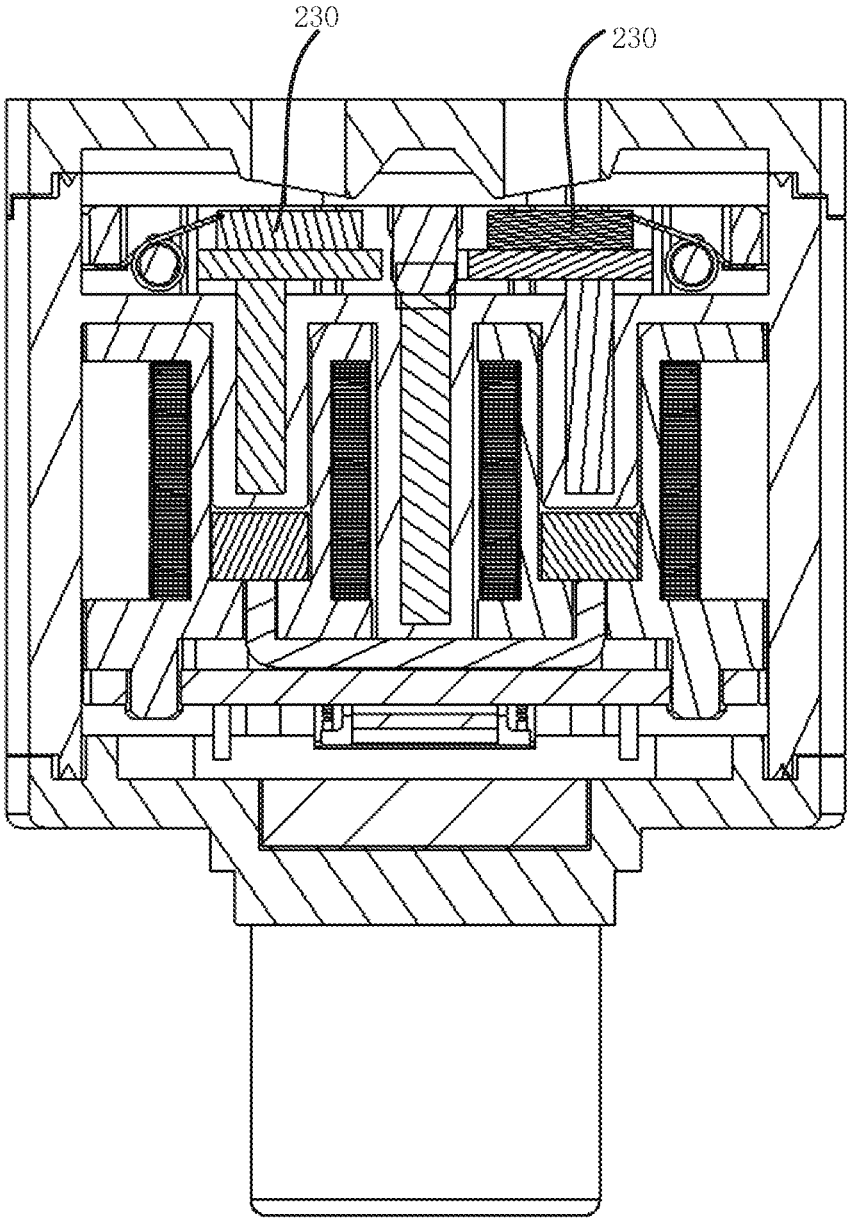
FIG. 9 is a schematic view of two paths of the electromagnetic distributor in an open state, according to an embodiment of the present application.

FIG. 6 illustrates a water flow path of the electromagnetic distributor according to the present application. FIG. 7 illustrates the electromagnetic distributor in a non-operating state according to the present application. FIG. 8 illustrates a single path of the electromagnetic distributor in an open state according to the present application. FIG. 9 illustrates two paths of the electromagnetic distributor in an open state according to the present application.

As shown in FIGS. 1-9, the electromagnetic distributor according to an embodiment of the present application further include an inlet end cap 400. The inlet end cap 400 is disposed at the first end of the housing 100. The inlet end cap 400 is configured with a water incoming chamber 410 thereon. The water incoming chamber 410 is in communication with the air, and the inlet of the water channel 110 is in communication with the water incoming chamber 410, such that the water outside can enter the water channel 110 via the water incoming chamber 410 and enter the water discharge chamber 210 via the water channel 110. When the plug 230 is open, the water flow can be sprayed out from the corresponding water outlet 220. The inlet end cap 400, the housing 100, and the splitter plate 250 can be ultrasonically welded together.

The inlet end cap 400 can seal the first end of the housing 100 to prevent water from entering the housing 100 at positions other than the water channel 110. The inlet end cap 400 can seal the first end of the housing 100 also to prevent impacts by incoming water on the solenoid valve assembly 300 and other parts in the housing 100. The shape of the inlet end cap 400 matches the shape of the first end of the housing 100 and the connection of the two may enhance the overall structure rigidity to prevent deformation.

As shown in FIG. 5, the spring bracket 240 may be assembled onto the housing 100 by means of hot melt posts 120. This method can greatly increase the assembly speed and improve the assembly efficiency.

Figure 10:
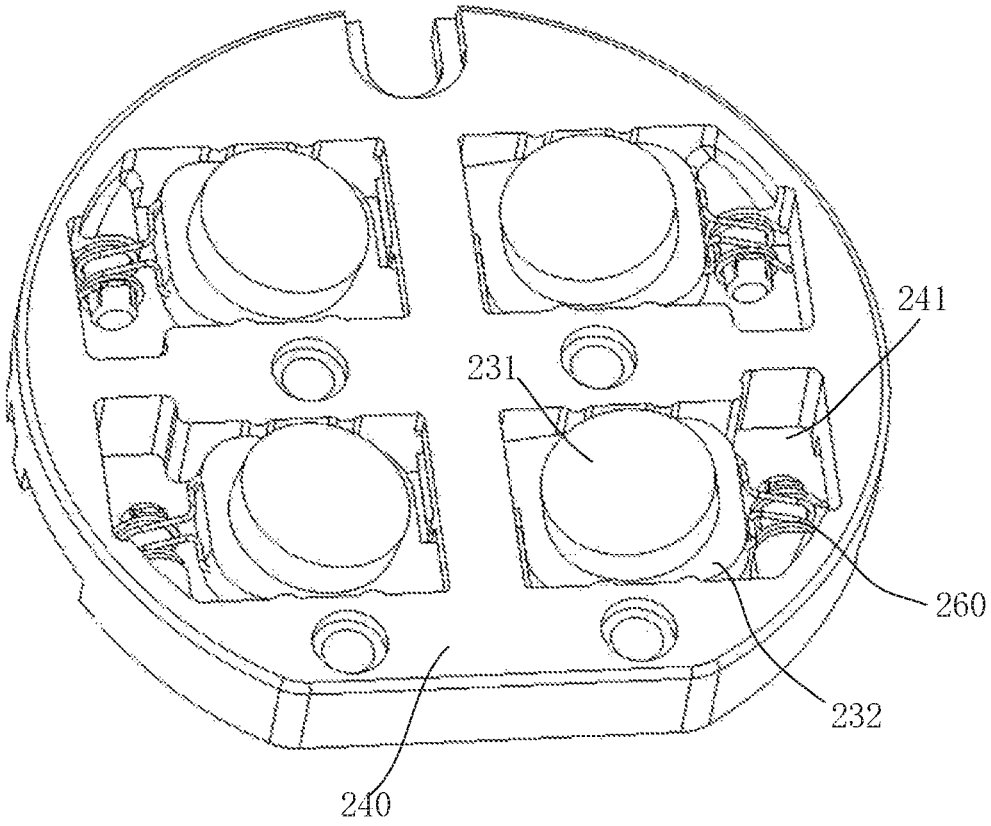
FIG. 10 is a schematic view of an assembly of the plug and the spring bracket, according to an embodiment of the present application.

FIG. 10 illustrates an assembly of the plug 230 and the spring bracket 240 according to some embodiments of the present disclosure. With reference to FIGS. 7-10, the spring bracket 240 is formed with at least two mounting grooves 241, the plugs 230 are correspondingly, one-to-one, mounted inside the mounting grooves 241. The metal sheet 232 of the plug 230 may be disposed in the corresponding mounting groove 241 via the elastic member 260. The elastic member 260 is a torsion spring in the embodiment shown. A first end of the metal sheet 232 (the left end of the metal sheet 232) is movably connected to a first inner wall of the mounting groove 241. This movable connection can constantly keep the first end of the metal sheet 232 at the connection position without moving along with a second end of the metal sheet 232, e.g., a joint connection, a rotating shaft connection, etc. The second end of the metal sheet 232 (the right end of the metal sheet 232) is connected to a second inner wall of the mounting groove 241 via the elastic member 260, or torsion spring. The second inner wall is opposite the first inner wall. In a non-operating state (the state as shown in FIG. 7), the elastic force produced by the torsion spring pushes the second end of the metal sheet 232 to the corresponding water outlet 220, such that the rubber gasket 231 seals the corresponding water outlet 220. The entire plug 230 appears to be in an inclined state, i.e., a distance between the first end of the metal sheet 232 and the water outlet 220 is greater than a distance between the second end of the metal sheet 232 and the water outlet 220. In an operating state (the state as shown in FIG. 9), the metal sheet 232 rotates about the first end when acted on by the electromagnetic force, such that the second end of the metal sheet 232 moves in a direction away from the water outlet 220, causing the rubber gasket 231 to leave the water outlet. The water outlet is opened, and the plug 230 is in an overall flat and straight state, i.e., substantially parallel to the spring bracket 240. This design has the following advantageous effects. The plug 230 does not move as a whole in the control process, but has one end always fixed, which prevents dislocation and leads to a more reliable structure and a long service life. The movement of only one end requires an electromagnetic force smaller than that required by the movement of the whole piece, leading to easy control and reduced consumption of electric energy.

In the implementation process of the present application, the solenoid valve assembly 300 may be implemented with various solenoid valves or other devices capable of controlling a magnetic field. An exemplary implementation manner is described below.

As shown in FIGS. 1-3, each of the electromagnetic switches 310 in the solenoid valve assembly 300 include a switch bracket 311 and a coil 312 wound around the switch bracket 311 (the structure as shown in FIGS. 2 and 3). A magnetic force is generated when the coil 312 is energized, and the magnetic force acts on the corresponding plug 230 to control an open/close state of the plug 230. The switch bracket 311 may be implemented by a plastic bracket, and the coil 312 may be implemented by an enameled wire. The enameled wire winds around the plastic bracket to form the coil 312. Two solder pins 313 may be provided on the plastic bracket for connection with two ends of the enameled wire, respectively. In use, a voltage is applied on the two solder pins 313 to energize the coil 312, thereby forming a desired electromagnetic field and converting the magnetic pole direction of the electromagnetic field by controlling the current direction.

As shown in FIG. 1, a control circuit board 320 may also be included. Two solder pins 313 on each of the electromagnetic switches 310 are soldered to the control circuit board 320, and the control circuit board 320 controls the energizing state of the coil 312. The control circuit board 320 may be implemented by an existing logic circuit, which inputs a forward or reverse voltage to the coil 312, thereby forming magnetic fields having different magnetic pole directions. A wire bundle 330 goes out of the control circuit board 320, and the wire bundle 330 may extend out via the inlet end cap 400 and be connected to an external controller. A user may input a control signal via the controller to control the water pattern.

Each of the coils 312 are inserted with a static iron core 350, and magnetic sheets 360 are mounted on the solenoid valve assembly 300. The embodiment shown in FIG. 8 includes a side magnetic sheet 360 and a bottom magnetic sheet 360. Every two groups of the electromagnetic switches 310 are connected with the bottom magnetic sheet 360 at the bottom, and then soldered to the control circuit board 320. The static iron core 350 and the side magnetic sheet 360 are assembled in a corresponding counterbore of the housing 100. The plug 230 is fixed by the spring bracket 240 and the side magnetic sheet 360, but can rotate about the spring bracket 240. This design can better control the generated magnetic field and achieve precise control. The principle thereof is similar to that of conventional solenoid valves and will not be elaborated herein.

The multiple arrows in FIG. 6 illustrate the entire path of the water flow. An external water flow enters the water channel 110 in the housing 100 via the water incoming chamber 410 on the inlet end cap 400, and enters the water discharge chamber 210 via the water channel 110. No water is sprayed out when the water outlets 220 are closed. When the water outlets 220 are open, the water flow in the water discharge chamber 210 is sprayed out via the opened water outlets 220.

Each of the coils 312 are configured with a permanent magnet 340. Through the cooperation between the permanent magnet 340 and the electromagnetic switch 310, long-time power-on can be prevented during the water discharging process. The role and effect of such a design will be described in detail below.

The operating principle and operating process of the electromagnetic distributor according to some embodiments of the present disclosure will be described in detail below through specific examples.

The non-operating state of the electromagnetic distributor is shown in FIG. 7. With reference to FIGS. 1-9, in the non-operating state, all the electromagnetic switches 310 are in the closed state, i.e., none of the coils 312 is energized and no electromagnetic field is generated. At this moment, each of the plugs 230 seals the corresponding water outlet 220 when acted on by the corresponding elastic member 260, and the water flow cannot be sprayed out from any one of the water outlets 220 after entering the water discharge chamber 210.

In the operating state, such as the open state of a single path as shown in FIG. 8, the water outlet 220 at the right in FIG. 8 is open. When a user chooses this water pattern, the control circuit board 320 first applies a forward pulse to the coil 312. The electromagnetic force generated by the electromagnetic switch 310 attracts the corresponding plug 230 downwardly, such that the plug 230 leaves the corresponding water outlet 220. The water outlet 220 is opened, and the water flow begins to be sprayed out from the water outlet 220. When the plug 230 is attracted to a corresponding position, the control circuit board 320 stops the input of the forward pulse, the coil 312 is powered off, and the electromagnetic force disappears. At this moment, the magnetic force acted on the plug 230 by the corresponding permanent magnet 340 is greater than the elastic force provided by the elastic member 260, and the plug 230 is stilled attracted by the permanent magnet 340 at the open position. When the user needs to terminate this spray or this spray is automatically terminated through a control program, the control circuit board 320 applies a reverse pulse to the coil 312, and the electromagnetic switch 310 produces an electromagnetic field opposite to the previous magnetic pole direction. The electromagnetic field produced at this moment has an opposite magnetism to that produced by the permanent magnet 340, thereby offsetting the magnetic force acted on the plug 230 by the permanent magnet 340. The elastic force provided by the elastic member 260 is greater than the magnetic force produced by mutual offset by two magnetic fields, thereby popping up the plug 230 to ultimately block the water outlet 220.

If the user chooses a combined water pattern, including but not limited to the dual-path water pattern as shown in FIG. 9, the electromagnetic switches 310 corresponding to the multiple paths are simultaneously energized for a short period, thereby opening a plurality of water outlets 220 to achieve the combined water pattern. The specific principles are similar to what is described above. Therefore, the process of a combined water pattern will not be described in detail.

Figure 11:
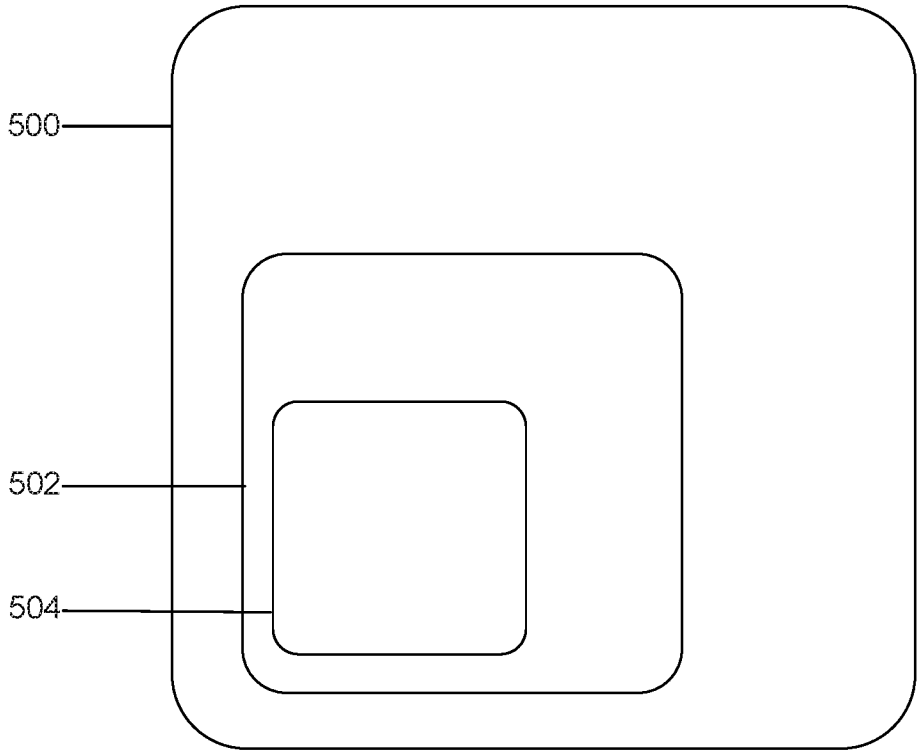
FIG. 11 is a schematic view of a toilet with a nozzle and the electromagnetic distributor, according to an embodiment of the present application.

Based on the same invention concept, the embodiments of the present application further provide a toilet 500, as shown in FIG. 11, including a nozzle 502 for cleaning bodies, and further including the electromagnetic distributor 504 according to any one of the above embodiments, wherein the electromagnetic distributor is disposed co-axially inside the nozzle, an outer wall of the housing 100 is attached to an inner wall of the nozzle and is configured in a sealed manner. The first end of the housing 100 faces an upstream direction of the nozzle, and the second end of the housing 100 faces a downstream direction of the nozzle.

The water flow from the upstream direction outputs a water pattern desired by a user to the downstream direction through the electromagnetic distributor. The specific control process of the electromagnetic distributor has been described in detail above and will not be elaborated herein. The toilet according to the embodiments of the present disclosure simplifies the internal structure of the nozzle, thereby improving the assembly efficiency. When the user switches to a different water pattern, the response time is quick and the wait time is shortened. Multiple water paths may be independently controlled to open or close, thereby achieving combined water patterns, providing more options for the user and improving the user experience. It should be understood that the electromagnetic distributor according to the embodiments of the present disclosure not only can be used on a toilet, but also can be used on other bathroom products and other products requiring water spray or liquid spray.

With the electromagnetic distributor and the toilet according to an embodiment of the present application, the solenoid valve assembly 300 can independently control each of the water outlets 220 to open or close, thereby achieving a water discharge mode desired by a user. Such electromagnetic distributor can be disposed inside a nozzle and does not need to be arranged separately outside the nozzle. Moreover, a plurality of water paths can be combined and switched by only introducing one water pipe into the nozzle, thereby simplifying the overall nozzle structure. The implementation of rapid switch and control of on and off of each water path in the nozzle as controlled by the solenoid valve assembly 300 greatly shortens the response time and can meet the requirements of rapid switch and control. In addition, a plurality of electromagnetic switches 310 are integrated. The plurality of electromagnetic switches 310 can divide one path of incoming water into a plurality of paths of water discharge, and the plurality of paths can be controlled independently with no mutual interference, thereby meeting diversified water discharge requirements.

Finally, it should be noted that the above embodiments are only used to describe the technical solution of the present application, rather than a limitation thereto. Although the present application has been described in detail with reference to the above embodiments, a person of ordinary skill in the art should understand that the technical solutions of the above embodiments may still be amended, or some technical features thereof may be replaced with equivalent parts. These amendments and replacements do not cause the essence of the corresponding technical solutions to depart from the scope of the technical solutions of the embodiments of the present application. Therefore, the protection scope of the present application shall be subject to the appended claims.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "front," "back," "left," "right," "up," "down," "top," "bottom," "above," "below") are merely used to describe the orientation of various elements in the FIGURES. The terms "inner" and "outer" refer to directions toward or away from geometric centers of particular parts, respectively. It should be noted that the orientation of various elements may differ according to other exemplary embodiments, and that such variations are intended to be encompassed by the present disclosure. Identical parts and components are represented by the same legends.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the toilets electromagnetic distributor, as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. An electromagnetic distributor, comprising:

a housing;

a water channel disposed within the housing, the water channel comprising an inlet, which is disposed at a first end of the housing, and an outlet, which extends toward a second end of the housing;

an inlet end cap disposed at the first end of the housing, wherein the inlet end cap has a water incoming chamber that is in communication with the air and the inlet of the water channel;

a water discharge assembly disposed at the second end of the housing, wherein the water discharge assembly comprises a spring bracket and a splitter plate;

a water discharge chamber disposed within the water discharge assembly, wherein an outlet of the water channel is in fluid communication with the water discharge chamber, wherein the spring bracket and the splitter plate together define the water discharge chamber, and wherein at least two water outlets are disposed on a face of the water discharge assembly furthest away from the housing;

a solenoid valve assembly disposed inside the housing, the solenoid valve assembly comprising at least two electromagnetic switches, each associated with one of the at least two water outlets, wherein each electromagnetic switch independently controls opening/closing of the associated water outlet; and a plug associated with each water outlet, wherein each plug is disposed in the water discharge chamber, and wherein each electromagnetic switch controls the opening/closing of the associated water outlet by independently controlling a state of the associated plug.

2. The electromagnetic distributor of claim 1, wherein the inlet end cap seals the first end of the housing.

3. The electromagnetic distributor of claim 1, wherein the spring bracket couples to one side of the solenoid valve assembly, the splitter plate couples to the spring bracket opposite the solenoid valve assembly, the at least two water outlets are configured on the splitter plate, and each plug mounts on the spring bracket.

4. The electromagnetic distributor of claim 3, wherein each plug couples to the spring bracket via one or more elastic members, wherein an elastic force of the one or more elastic members causes the associated plug to seal the associated water outlet.

5. The electromagnetic distributor of claim 4, wherein the spring bracket is configured with at least two mounting grooves, wherein the associated plug mounts inside the mounting grooves, and wherein a first end of each plug is moveably connected to a first inner wall of the mounting groove, a second end of the plug is coupled, via the elastic member, to a second inner wall of the mounting groove opposite the first inner wall, and an elastic force of the one or more elastic members causes the second end of the plug to approach the associated water outlet.

6. The electromagnetic distributor of claim 5, wherein a distance between the first end of each plug and the associated water outlet is greater than a distance between the second end of the plug and the water outlet in a non-operating state.

7. The electromagnetic distributor of claim 6, wherein each of the electromagnetic switches comprises a switch bracket and a coil wound around the switch bracket, wherein a magnetic force is generated during energization of the coil, and wherein the magnetic force acts on the associated plug to control the opening/closing of the plug.

8. The electromagnetic distributor of claim 7, further comprising a control circuit board that controls the energization of the coil.

9. The electromagnetic distributor of claim 8, wherein each coil comprises a permanent magnet.

10. The electromagnetic distributor of claim 9, wherein each coil comprises a static iron core, and wherein one or more magnetic sheets are mounted on the solenoid valve assembly.

11. The electromagnetic distributor of claim 1, wherein the electromagnetic distributor is used on a plurality of bathroom products and other products requiring liquid spray.

12. A toilet, comprising:

a nozzle; and an electromagnetic distributor comprising:

a housing;

a water channel disposed within the housing and comprising an inlet, which is disposed at a first end of the housing, and an outlet, which extends toward a second end of the housing;

a water discharge assembly disposed at the second end of the housing;

a water discharge chamber disposed within the water discharge assembly, wherein an outlet of the water channel is in fluid communication with the water discharge chamber, and at least two water outlets disposed on a face of the water discharge assembly furthest away from the housing; and a solenoid valve assembly disposed inside the housing and comprising at least two electromagnetic switches, each associated with one of the at least two water outlets, wherein each electromagnetic switch independently controls opening/closing of the associated water outlet, wherein the electromagnetic distributor is disposed inside the nozzle, an outer wall of the housing couples to an inner wall of the nozzle, the first end of the housing faces an upstream direction of the nozzle, and the second end of the housing faces a downstream direction of the nozzle.

13. The toilet of claim 11, further comprising an inlet end cap disposed at the first end of the housing, wherein the inlet end cap has a water incoming chamber that is in communication with the air and the inlet of the water channel.

14. The toilet of claim 13, wherein the inlet end cap seals the first end of the housing.

15. The toilet of claim 12, wherein a water flow from the upstream direction outputs a water pattern desired by a user to the downstream direction through the electromagnetic distributor.

16. The toilet of claim 12, wherein a plurality of water paths are configured to be combined and switched with a singular water pipe into the nozzle.

17. The toilet of claim 12, wherein the at least two electromagnetic switches divide one path of incoming water into a plurality of paths of water discharge, and the plurality of paths can be controlled independently with no mutual interference.

* * * * *